US010053202B2

(12) United States Patent
Weber et al.

(10) Patent No.: US 10,053,202 B2
(45) Date of Patent: Aug. 21, 2018

(54) MARINE ELECTRIC POWER ASSIST STEERING RACK AND PINION

(71) Applicant: Steering Solutions IP Holding Corporation, Saginaw, MI (US)

(72) Inventors: John E. Weber, Pinconning, MI (US); Matthew R. Burk, Bay City, MI (US); Andrew E. Maschke, Carolton, MI (US)

(73) Assignee: STEERING SOLUTIONS IP HOLDING CORPORATION, Saginaw, MI (US)

( * ) Notice: Subject to any disclaimer, the term of this patent is extended or adjusted under 35 U.S.C. 154(b) by 0 days.

(21) Appl. No.: 15/293,706

(22) Filed: Oct. 14, 2016

(65) Prior Publication Data

US 2017/0106961 A1 Apr. 20, 2017

Related U.S. Application Data

(60) Provisional application No. 62/242,365, filed on Oct. 16, 2015.

(51) Int. Cl.

| | |
|---|---|
| ***B63H 25/00*** | (2006.01) |
| ***B63H 25/42*** | (2006.01) |
| ***B63H 20/12*** | (2006.01) |

(52) U.S. Cl.
CPC ..... *B63H 25/42* (2013.01); *B63H 20/12* (2013.01)

(58) Field of Classification Search
CPC ..... B63H 20/12; B63H 25/42
USPC ..... 440/1
See application file for complete search history.

(56) References Cited

U.S. PATENT DOCUMENTS 5,357,889 A * 10/1994 Wood ..... B63H 25/04 114/144 E
7,533,624 B2 * 5/2009 Mizutani ..... B63H 20/12 114/144 E

* cited by examiner

*Primary Examiner* — Stephen P Avila
(74) *Attorney, Agent, or Firm* — Cantor Colburn LLP

(57) ABSTRACT

A marine electric power steering system includes an actuator assembly, a power steering module, and a cable assembly. The actuator assembly includes an actuator assembly input and an actuator assembly output. The actuator assembly input is operatively coupled to a steering shaft. The power steering module includes a power steering module input that is operatively coupled to the actuator assembly output and a power steering module output. The cable assembly is operatively coupled to the actuator assembly output and the power steering module input.

11 Claims, 2 Drawing Sheets

MARINE ELECTRIC POWER ASSIST STEERING RACK AND PINION

CROSS-REFERENCES TO RELATED APPLICATIONS

This patent application claims priority to U.S. Provisional Patent Application Ser. No. 62/242,365, filed Oct. 16, 2015 which is incorporated herein by reference in its entirety.

BACKGROUND OF THE INVENTION

Marine vessels equipped with outboard motors conventionally use a steering system having a steering wheel remotely located from the outboard motor. The steering system generally incorporates hydraulic systems including a motor, a pump, hydraulic fluid tank, valves, and switches to assist and/or smooth out the loads encountered when steering. The hydraulic steering systems may present challenges such as a high cost, possible hydraulic fluid leaks, high energy usage, and difficulty in installing. Other mechanical steering systems, such as, cable steering systems, also present challenges such as rough and uneven steering force application, vibrations from the outboard motor transmitted to the helm, and difficulty in routing the cables.

SUMMARY OF THE INVENTION

According to an embodiment of the present disclosure, a marine electric power steering system is provided. The marine electric power steering system includes a steering sensor, an actuator assembly, a power steering module, and a cable assembly. The steering sensor is arranged to measure at least one of a torque applied to and a rotational position of a steering wheel operatively connected to a steering shaft. The actuator assembly is in communication with the steering sensor. The actuator assembly has an actuator assembly output. The power steering module has a power steering module input and a power steering module output operatively connected to a steering device. The cable assembly extends between the actuator assembly output and the power steering module input.

According to another embodiment of the present disclosure, a marine electric power steering system is provided. The marine electric power steering system includes an actuator assembly, a power steering module, and a cable assembly. The actuator assembly includes an actuator assembly input and an actuator assembly output. The actuator assembly input is operatively coupled to a steering shaft. The power steering module includes a power steering module input that is operatively coupled to the actuator assembly output and a power steering module output. The cable assembly is operatively coupled to the actuator assembly output and the power steering module input.

According to yet another embodiment of the present disclosure, a marine electric power steering system is provided. The marine electric power steering system includes an actuator assembly and a power steering module. The actuator assembly is in communication with a steering sensor that is arranged to monitor at least one of a rotational position and a torque applied to a steering wheel that is operatively connected to a steering shaft. The actuator assembly includes an actuator assembly input and an actuator assembly output. The power steering module includes a power steering module input and a power steering module output. The actuator assembly output is arranged to actuate the power steering module input, in response to at least one of a change in rotational position and the torque applied to the steering wheel that is operatively connected to the steering shaft.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Referring now to the Figures, where the invention will be described with reference to specific embodiments, without limiting same, it is to be understood that the disclosed embodiments are merely illustrative examples of the present disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
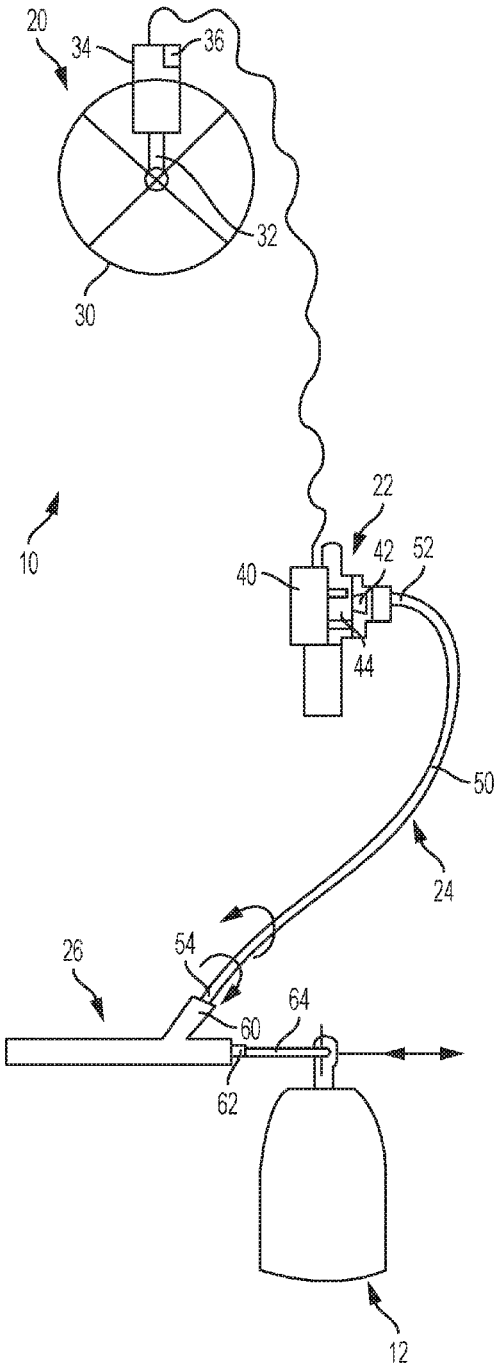
FIG. 1 is disassembled view of a marine electric power steering system according to an aspect of the invention is shown.

Referring to FIG. 1, a marine electric power steering system 10 is shown. The marine electric power steering system 10 may be provided with a marine vessel such as a boat. The marine electric power steering system 10 is operatively connected to a steering device 12. The steering device 12 may be an outboard motor that is pivotally connected to a hull structure or a transom of the marine vessel.

The marine electric power steering system 10 is configured to pivot or rotate the steering device 12 to steer or maneuver the marine vessel without employing a hydraulic system. The marine electric power steering system 10 employs electric power assist components to assist an operator in steering the marine vessel.

The marine electric power steering system 10 includes a helm 20, an actuator assembly 22, a power steering module 26, and a cable assembly 24.

The helm 20 includes a steering wheel 30 that is connected to a steering shaft 32 that extends into a steering column 34 and a steering sensor 36. An operator of the marine vessel is able to provide a steering input into the steering wheel 30 such that the steering shaft 32 and the steering wheel 30 rotates about a steering column axis. The steering sensor 36 is arranged or positioned to measure or to monitor a rotational position or an angular position of the steering shaft 32 and/or the steering wheel 30. The steering sensor 36 is arranged or positioned to measure or to monitor a torque applied to the steering shaft 32 and/or the steering wheel 30. The steering sensor 36 is configured to provide a signal indicative of the rotational position, the angular position, and/or the torque applied to the steering shaft 32 and of the steering wheel 30 to the actuator assembly 22.

The actuator assembly 22 is configured as a column electric power steering unit (CEPS). The actuator assembly 22 is in communication with the steering sensor 36 of the helm 20. There is no direct mechanical connection between the actuator assembly 22 and the helm 20. The actuator assembly 22 is in wireless or wired communication with the steering sensor 36 of the helm 20. The actuator assembly 22 is a variable output torque mechanism that provides a steering assist torque to assist an operator of the marine vessel in steering the vehicle. The actuator assembly 22 provides torque multiplication of an input torque applied to the steering wheel 30 and/or the steering shaft 32 of the helm 20 to the power steering module 26.

The actuator assembly 22 includes an actuator assembly input 40, an actuator assembly output 42, and an electric motor 44. The actuator assembly input 40 may be configured to receive the signal from the steering sensor 36. The actuator assembly output 42 is operatively connected to the electric motor 44 and the cable assembly 24. The electric motor 44 is arranged to actuate or impart rotation to the actuator assembly output 42 to rotate the cable assembly 24 to actuate the power steering module 26 in response to at least one of the torque applied to and the angular position/rotational position of the steering wheel 30 that is operatively connected to the steering shaft 32.

The cable assembly 24 is operatively connected to the actuator assembly 22 and the power steering module 26. The cable assembly 24 is configured as a rotary cable that imparts the rotary motion of the actuator assembly output 42 on an input of the power steering module 26. The cable assembly 24 includes a cable body 50 that extends between a first end 52 and a second end 54. The first end 52 is configured as a rotary coupling that is operatively connected to the actuator assembly output 42. The second end 54 is operatively connected to an input of the power steering module 26. The rotation of the cable assembly 24 in response to rotation of the actuator assembly output 42 supplies a torque to the power steering module 26.

The power steering module 26 includes a power steering module input 60, a power steering module output 62, and a shaft 64 that extends from an end of the power steering module output 62. The power steering module 26 is configured as a linear actuator such as a rack electronic power steering system. The rack electronic power steering system is provided with a rack and pinion steering mechanism. The rack and pinion steering mechanism includes an electric motor drive, a motor pinion gear, and a toothed rack from which the shaft 64 extends.

The electric motor drive is meshingly connected to the toothed rack by the motor pinion gear, such that the motor pinion gear is in meshed engagement with the toothed rack. The operation of the electric motor drive results in rotation of the motor pinion gear to translate the toothed rack. In at least one embodiment, the toothed rack is configured as a ballscrew mechanism, belt drive, or other gear interface capable of providing linear motion. The shaft 64 is disposed proximate an end of the toothed rack and operatively connects the power steering module 26 to the steering device 12. In response to rotation of the power steering module input 60, the linear actuator, i.e. the toothed rack, translates and the shaft 64 pivots the steering device 12 about a pivot.

Figure 2:
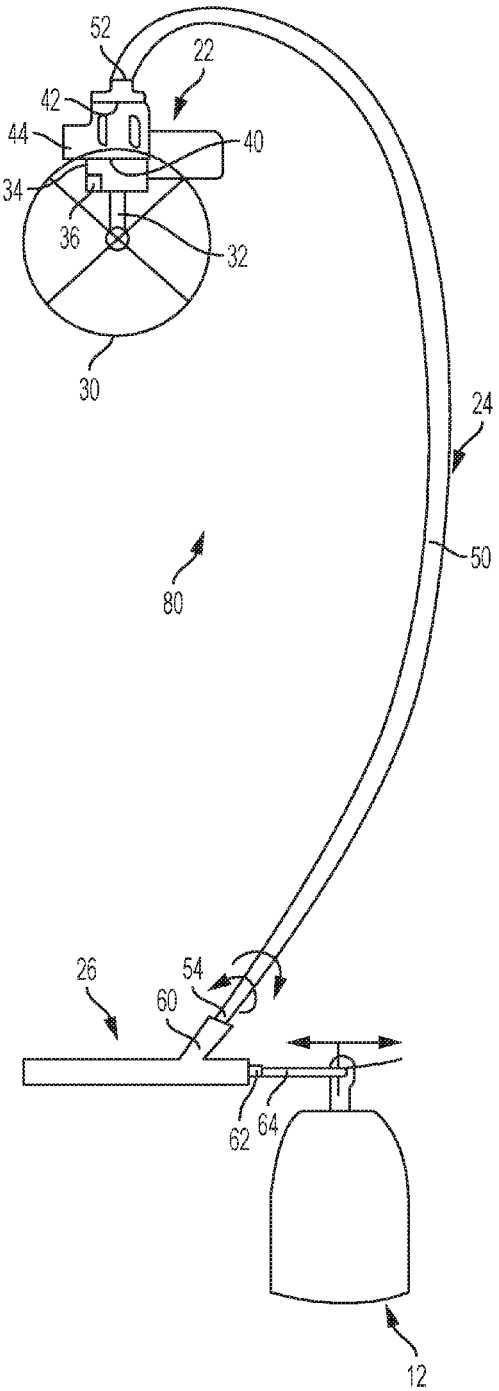
FIG. 2 is a disassembled view of a marine electric power steering system according to another aspect of the invention is shown.

Referring to FIG. 2, an alternative arrangement of a marine electric power steering system 80 is shown. The marine electric power steering system 80 includes the helm 20, the actuator assembly 22, the cable assembly 24, and the power steering module 26.

The actuator assembly 22 is directly connected to the helm 20. The actuator assembly 22 is operatively connected to and engages the steering column 34. The actuator assembly input 40 and/or the electric motor 44 are directly connected to the steering shaft 32.

The actuator assembly 22 is configured to provide torque multiplication of the input torque applied to the steering wheel 30 and/or the steering shaft 32 of the helm 20 and is configured to apply a feedback torque to the steering shaft 32. The electric motor 44 of the actuator assembly 22 is arranged to rotate the actuator assembly output 42 in a first direction to rotate the cable assembly 24 to supply a torque to the power steering module input 60 of the power steering module 26 to actuate or pivot the steering device 12, in response to at least one of a torque applied to the steering shaft 32 and/or the steering wheel 30 or a change in rotational/angular position of the steering shaft 32 and/or the steering wheel 30.

The electric motor 44 of the actuator assembly 22 is also arranged to rotate the actuator assembly input 40 in a second direction that is disposed opposite the first direction to apply a feedback torque to the steering shaft 32. The feedback torque provides a resistance to rotation of the steering wheel 30 and/or the steering shaft 32 that an operator of the marine vessel is able to feel. An amount of the feedback torque is based on at least one of a speed of the marine vessel and a rotational position or angular position of the steering shaft 32 relative to an end of travel stop. For example, the amount of feedback torque may be increased as the steering shaft 32 approaches the end of travel stop and the amount of feedback torque may be decreased as the steering shaft 32 rotates away from the end of travel stop.

Figure 3:
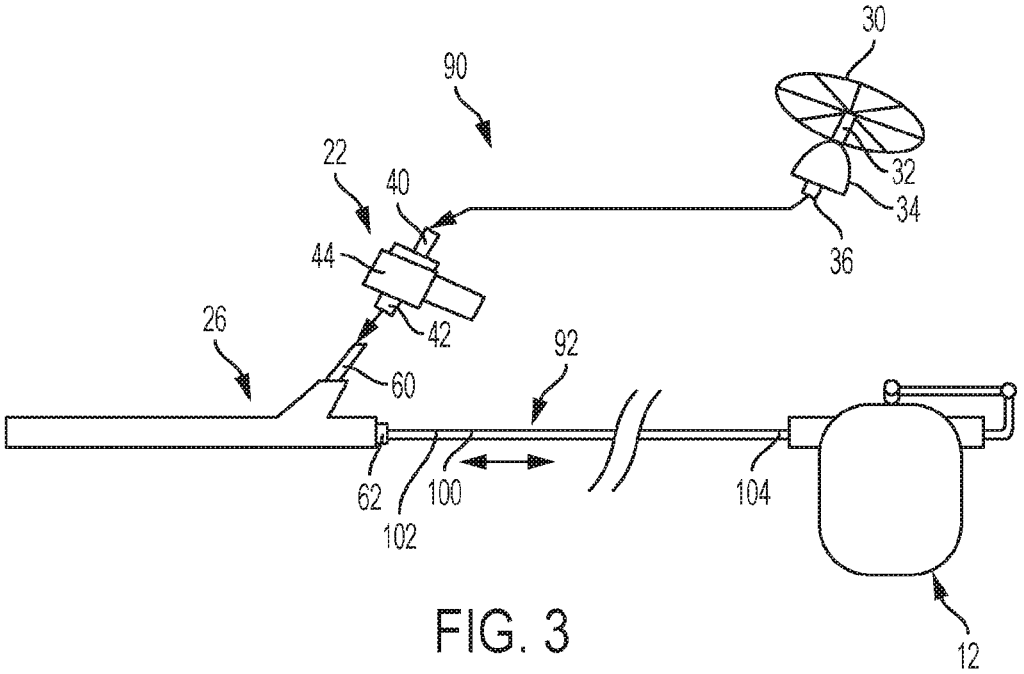
FIG. 3 is a disassembled view of a marine electric power steering system according to yet another aspect of the invention is shown.

Referring to FIG. 3, another alternative arrangement of a marine electric power steering system 90 is shown. The marine electric power steering system 90 includes the helm 20, the actuator assembly 22, the power steering module 26, and a cable assembly 92.

The actuator assembly 22 may be in communication with the helm 20. The actuator assembly 22 is directly connected to the power steering module 26. The actuator assembly output 42 of the actuator assembly 22 is directly connected to the power steering module input 60 of the power steering module 26.

The cable assembly 92 is configured as a push pull cable assembly. The cable assembly 92 extends between the power steering module 26 and the steering device 12. The cable assembly 92 includes a cable body 100 that extends between a first end 102 and a second end 104. The first end 102 is operatively connected to the power steering module output 62. The second end 104 is operatively connected to the steering device 12. Responsive to rotation or actuation of the steering wheel 30 and/or the steering shaft 32 of the helm 20, the power steering module output 62 is arranged to push or pull the cable assembly 92 to pivot the steering device 12 about a pivot to steer the marine vessel.

Throughout this specification, the term "attach," "attachment," "connected," "coupled," "coupling," "mount," or "mounting" shall be interpreted to mean that a structural component or element is in some manner connected to or contacts another element, either directly or indirectly through at least one intervening structural element, or is integrally formed with the other structural element.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A marine electric power steering system, comprising:

a steering sensor arranged to measure at least one of a torque applied to and a rotational position of a steering wheel operatively connected to a steering shaft;

an actuator assembly in communication with the steering sensor, the actuator assembly having an actuator assembly output and an electric motor; and a cable assembly extending between the actuator assembly output and a power steering module input, the electric motor is arranged to impart rotation to the actuator assembly output that rotates the cable assembly to rotate the power steering module input, in response to at least one of the torque applied to and the rotational position of the steering wheel operatively connected to the steering shaft.

2. The marine electric power steering system of claim 1, wherein the actuator assembly is spaced apart from the steering shaft and the steering wheel.

3. The marine electric power steering system of claim 1, wherein the power steering module output is configured as a linear actuator that is operatively connected to a steering device.

4. The marine electric power steering system of claim 3, wherein in response to rotation of the power steering module input the linear actuator translates to pivot the steering device.

5. A marine electric power steering a system comprising:

an actuator assembly including an actuator assembly input connected to a steering shalt, an actuator assent output, an electric motor, and a steering sensor arranged to measure at least one of a torque applied to and a rotational position of the steering shaft;

a power steering module including a power steering module input that is operatively coupled to the actuator assembly output and a power steering module output that includes a linear actuator that is operatively coupled to a steering device; and a cable assembly operatively coupled to the actuator assembly output and the power steering module input, the electric motor is arranged to rotate the actuator assembly output in a first direction to rotate the cable assembly in response to at least one of the torque applied to and the rotational position of the steering shaft.

6. The marine electric power steering system of claim 5, wherein in response to rotation of the power steering module input by the cable assembly, the linear actuator translates to move the steering device.

7. The marine electric power steering system of claim 5, wherein the electric motor is arranged to rotate the actuator assembly input in a second direction opposite the first direction to apply a feedback torque to the steering shaft.

8. The marine electric power steering system of claim 7, wherein an amount of the feedback torque is based on at least one of a speed of a marine vessel and the rotational position of the steering shaft.

9. A marine electric power steering system comprising:

an actuator assembly in communication with a steering sensor arranged to monitor at least one of a rotational position and a torque applied to a steering wheel that is operatively connected to a steering shaft, the actuator assembly including an actuator assembly input and an actuator assembly output;

a power steering module including a power steering module input and a power steering module output, in response to at least one of a change in rotational position and the torque applied to the steering wheel that is operatively connected to the steering shaft, the actuator assembly output is arranged to actuate the power steering module input; and a cable assembly having a first end operatively coupled to the actuator assembly output and a second end operatively coupled to a steering device, in response to actuation of the power steering module input, the power steering module output is arranged to at least one of push and pull the cable assembly to move the steering device.

10. The marine electric power steering system of claim 9, wherein the steering device is an outboard motor that is pivotally connected to a transom.

11. The marine electric power steering system of claim 10, wherein the actuator assembly input is operatively connected to the steering shaft.

* * * * *